US009950325B2

(12) United States Patent
Alam

(10) Patent No.: US 9,950,325 B2
(45) Date of Patent: Apr. 24, 2018

(54) CARBON FIBER COMPOSITE DISCHARGE ELECTRODE WITH MECHANICAL BIAS

(71) Applicant: Ohio University, Athens, OH (US)

(72) Inventor: Khairul Alam, Athens, OH (US)

(73) Assignee: Ohio University, Athens, OH (US)

( * ) Notice: Subject to any disclaimer, the term of this patent is extended or adjusted under 35 U.S.C. 154(b) by 131 days.

(21) Appl. No.: 14/900,377

(22) PCT Filed: Jun. 19, 2014

(86) PCT No.: PCT/US2014/043207

§ 371 (c)(1),
(2) Date: Dec. 21, 2015

(87) PCT Pub. No.: WO2014/209754

PCT Pub. Date: Dec. 31, 2014

(65) Prior Publication Data

US 2016/0151790 A1 Jun. 2, 2016

Related U.S. Application Data

(60) Provisional application No. 61/840,527, filed on Jun. 28, 2013.

(51) Int. Cl.

| | |
|---|---|
| ***B03C 3/41*** | (2006.01) |
| ***B03C 3/60*** | (2006.01) |
| ***B03C 3/86*** | (2006.01) |

(52) U.S. Cl.

CPC ..... *B03C 3/41* (2013.01); *B03C 3/60* (2013.01); *B03C 3/86* (2013.01); *B03C 2201/04* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,352,635 | A | 7/1944 | Irwin | |
| 6,231,643 | B1 | 5/2001 | Pasic et al. | |
| 7,438,742 | B2 * | 10/2008 | Smith | B03C 3/86 248/339 |
| 7,976,616 | B2 * | 7/2011 | Alam | B03C 3/41 313/351 |
| 9,114,404 | B2 * | 8/2015 | Alam | B03C 3/41 |
| 2008/0190296 | A1 | 8/2008 | Alam | |
| 2012/0227588 | A1 | 9/2012 | Alam | |

* cited by examiner

*Primary Examiner* — Frank Lawrence
*Assistant Examiner* — Sonji Turner
(74) *Attorney, Agent, or Firm* — Jason H. Foster; Kremblas & Foster

(57) ABSTRACT

A discharge electrode using carbon fibers, nanofibers and/or nanotubes to generate the corona discharge. The invention contemplates conductive fiber, such as carbon strands with or without a polymer matrix to form a composite, and a supporting configuration in which the strand is extended along or wrapped helically around a supporting rod that extends along the length of the electrode. A mechanical bias is applied to each strand to maintain tension on the strand. Preferably this includes coil springs extending between bushings mounted on the rod and moveable hemispherical supports slidably mounted on the rod that seat against the strand.

12 Claims, 4 Drawing Sheets

SUMMARY

| | CURRENT AT DIFFERENT VOLTAGES | | |
|---|---|---|---|
| | **30kV** | **40kV** | **44kV** |
| FLAT 3 INCH | 0.81 | 1.78 | 2.4 |
| OU DESIGN | 1.34 | 2.88 | 3.9 |
| RATIO | 1.65 | 1.62 | 1.63 |
| % IMPROVEMENT | 65% | 62% | 63% |

| ELECTRODE TYPE | | **FLAT 3 INCH** | |
|---|---|---|---|
| RAW DATA INPUT | | CONVERSION | |
| VDC | mA | KVDC | mA |
| 0.100 | 0.04 | 10.00 | 0.004 |
| 0.200 | 1.50 | 20.00 | 0.150 |
| 0.300 | 8.10 | 30.00 | 0.810 |
| 0.400 | 17.80 | 40.00 | 1.780 |
| 0.440 | 24.00 | 44.00 | 2.400 |
| 0.480 | 30.00 | 48.00 | 3.000 |
| 0.520 | 37.80 | 52.00 | 3.780 |

| ELECTRODE TYPE | | **3 TAPE** | |
|---|---|---|---|
| RAW DATA INPUT | | CONVERSION | |
| VDC | mA | KVDC | mA |
| 0.100 | 0.44 | 10.00 | 0.044 |
| 0.200 | 4.30 | 20.00 | 0.430 |
| 0.300 | 13.40 | 30.00 | 1.340 |
| 0.400 | 28.80 | 40.00 | 2.880 |
| 0.440 | 39.00 | 44.00 | 3.900 |

CARBON FIBER COMPOSITE DISCHARGE ELECTRODE WITH MECHANICAL BIAS

BACKGROUND OF THE INVENTION

Charging electrodes are critical components used in electrostatic precipitators (ESPs), which are devices used to collect particles from gas streams, such as the streams from electric power plants burning coal. Examples of such devices are shown in U.S. Pat. No. 6,231,643 to Pasic, et al., United States Patent Application Publication No. US2008/0190296 published Aug. 14, 2008, and United States Patent Application Publication No. US2012/0227588 published Sep. 13, 2012, all of which are incorporated herein by reference.

The most basic ESP contains a row of wires followed by a stack of spaced, planar metal plates. A high-voltage power supply transfers electrons from the plates to the wires, developing a negative charge of thousand of volts on the wires relative to the collection plates. In a typical ESP, the collection plates are grounded, but it is possible to reverse the polarity.

The gas stream and particles flow through the spaces between the wires, and then pass through the rows of plates. During this, the gases are ionized by the charging electrode, forming a corona. As particles are carried through the ionized gases, the particles become negatively charged. When the charged particles move past the grounded collection plates, the strong attraction causes the particles to be drawn toward the plates until there is impact. When the particles contact the grounded plate, they give up electrons, and thus act as part of the collector. Automatic "rapping" systems and hopper evacuation devices remove the collected particulate matter while the ESPs are being used, thereby allowing ESPs to stay in operation for long periods of time.

Discharge electrodes have been developed that include rigid structures to which many sharpened spikes are attached, maximizing corona production. ESPs perform better if the corona is stronger and covers most of the flow area so particles cannot flow around the charging zones and escape being charged, which is called "sneakage".

Conventional discharge electrodes are supported on a metal structure, which typically includes a support rod. The rods are conductive in order to electrically connect each spike point with the power supply. Generally, it is considered necessary to have metal spikes that can withstand the electrical currents that often flow due to sparking over between the collection substrate and discharge electrode. In corrosive operating conditions, the sharp spikes of the charging electrodes are also typically made of an expensive alloy (e.g., HASTELLOY brand alloy) to avoid or mitigate corrosion in the harsh environments in which such electrodes are used. Since the entire discharge electrode, including the rod, is commonly made of the same alloy, the electrodes become expensive and heavy, thereby requiring strong support structures.

Polymers are inexpensive, light and corrosion-resistant, but they do not conduct electricity, and they have poor tensile/flexural strength. Even conductive composites have much lower conductivity than metals. Therefore, the need exists for a discharge electrode that is lightweight and inexpensive, but still has a sufficient current flow and particle collection efficiency.

BRIEF SUMMARY OF THE INVENTION

The invention is a new design of charging electrodes using carbon fibers to generate the corona discharge. A goal of the technology is to produce low cost electrodes that are corrosion resistant. The invention includes electrodes made of carbon fiber within a polymer matrix to form a composite. Composites are much lighter than metals, and therefore the weight of the electrode is reduced. Composites have high strength and can be used to fabricate electrodes of high durability and long operating life.

The technology has strong potential applications in the pollution control from boiler exhausts, dry and wet ESPs and air-purifiers. The technology could help provide cost savings due to high strength and corrosion-resistant properties of the electrodes.

The invention has several advantages over other commercially available charging electrodes, including improvement in the charging characteristics of the electrode; lower cost of the electrodes due to use of inexpensive, lighter materials and simpler design; lower cost of overall equipment as the cost of any supporting structure is eliminated or reduced. Furthermore, variations in the composition and physical configuration of the electrodes are feasible depending on the requirements and conditions of their operation, and collection efficiency is improved due to improvement in the airflow pattern. Corrosion resistance is enhanced in environments that would adversely affect metallic electrodes.

Electrodes of different designs have been fabricated according to the invention and tested under a set of varying conditions to determine their performance. Tests were performed to determine the voltage-current (V-I) characteristics. It was observed that electrodes using carbon fibers as sources of corona discharge had improved corona current at varying voltage levels as compared to expensive stainless steel electrodes.

Figure 1:
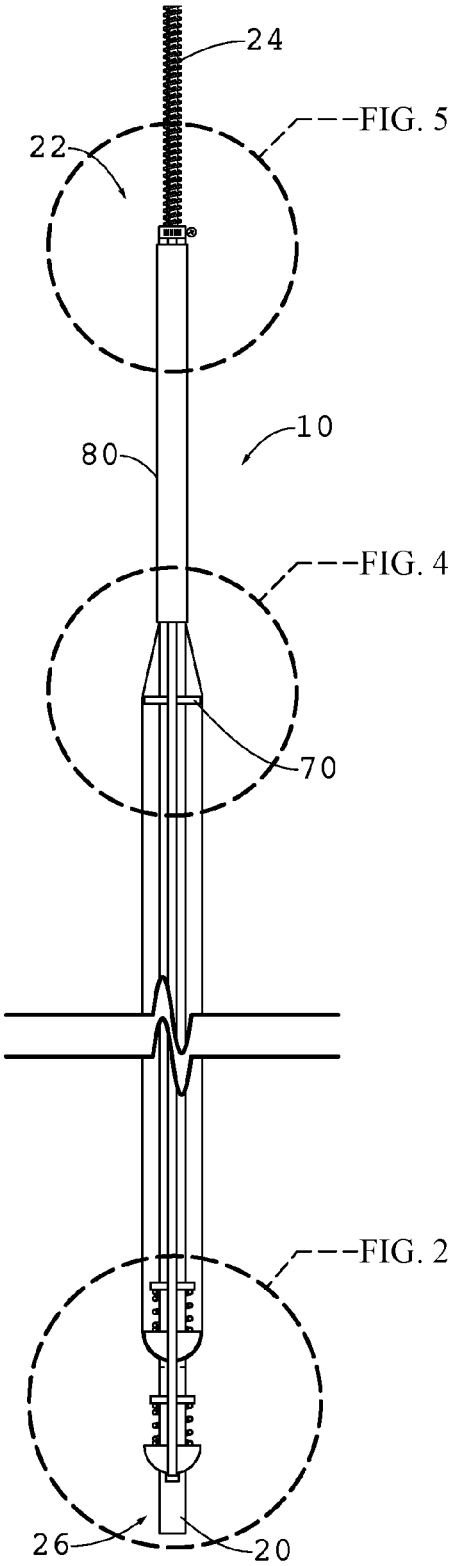
FIG. 1 is a side view illustrating an electrode in accordance with the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

As shown in FIG. 1, a discharge electrode 10 includes a non-conductive support rod 20, such as a rod made of a polymer (e.g., poly vinyl chloride, PVC) or a glass fiber-reinforced polymer tube. Electrically conductive, non-metallic fibers such as carbon fibers and carbon nanofibers are infiltrated with a flexible polymer matrix to form at least one composite strand. In some cases in which nanofibers are in a composite, the ends of the nanofibers serve as points to support a corona. The composite strand is supported in the longitudinal direction by the support rod 20, such as by extending the conductive filaments along the rod and applying a bias in the longitudinal direction to maintain the strand in tension.

One contemplated strand is a carbon fiber reinforced polymer tape (e.g., Polyphenylene sulfide (PPS) polymer with AS4 carbon fiber) that is about 0.5 inch wide and approximately 0.007 inch thick. If different dimensions or materials are preferable, other choices are commercially available, and tapes from a few fibers wide (microns) to several inches wide are contemplated. Tests have been performed with tape made from other carbon fibers (e.g., Besfight G30), other polymers (e.g. polypropylene), and different thicknesses (up to 0.02 inch). The present invention uses tows of fibers that are infiltrated with a matrix material, such as a resin. It is preferred that the conducting filaments have a small diameter (e.g., 5-7 microns for continuous fibers, and much thinner for nanofibers).

In the embodiment shown in FIGS. 1-5, the rod 20 forms the structural backbone of the electrode 10, and is preferably a fiberglass reinforced polymer matrix tube with an outer diameter of about one inch. The top end 22 of the rod 20 is plugged with a solid plastic cylindrical "plug" cemented to the rod 20 and drilled/tapped to receive a threaded rod 24, which may be a threaded (e.g., "all-thread") stainless steel cylinder about 12 inches long.

The threaded rod 24 is used because it attaches well to a conventional ESP discharge electrode mounting structure, thus allowing the electrode 10 to be installed in place of an existing conventional discharge electrode. In place, the threaded rod 24 extends through an aperture in a rigid structure and one or more nuts on the threaded rod 24 are tightened against opposing sides of the rigid structure to position the electrode 10 as desired. The remainder of the electrode 10 hangs beneath the rigid structure in the manner of a cantilever. Of course, any other structure can be used as the means of attaching the electrode 10 to the ESP, depending on the surrounding structures. This will become apparent to the person having ordinary skill from the description herein.

In a preferred embodiment, the electrode 10 extends across a path through which gases flow (not shown). The rod 20 extends in the manner of a cantilever from the threaded rod 24 to a lower end 26 shown in FIG. 2, and has substantial rigidity to limit the extent to which the rod 20 bends along its length during operation of the ESP. The rod has a pair of apertures 28 and 29 formed through it at spaced points as best viewed in FIG. 2. These apertures 28 and 29 are preferably formed along skewed lines that are oriented at about ninety degree angles from one another and spaced several inches to allow the conductive tapes 32 and 34, which form the conductive composite strand of this embodiment, to extend through the rod 20 as is described next.

Two conductive tapes 32 and 34 are arranged along the outside of the rod 20, and spaced radially from the rod 20. The tape 32 extends from the rod's top end 22 at the collar 40, which is preferably a conductive metal clamp, down the rod 20 to and through the aperture 29, and then upward to the top end 22 at the collar 40. The tape 34 extends from the rod's top end 22 at the collar 40, down the rod 20 to and through the aperture 28, and then upward to the top end 22 at the collar 40. Both tapes 32 and 34 are clamped beneath the collar 40 and are held in place by frictional engagement and the clamping effect of the collar 40 to the rod 20. As best viewed in FIG. 5, the collar 40 is made of a conductive metal and is preferably conductively linked to the threaded rod 24 by a conductive wire 42 welded to both the collar 40 and the threaded rod 24. Although the electrical connection from the carbon composite tape to the threaded rod 24 is made by using a wire joined by two stainless steel hose clamps, for other uses it may be preferred to use a clamp that makes better contact with the tapes and a welded joint at the threaded rod 24.

The tapes 32 and 34 thus form a conductive loop extending from at least the collar 40, and more preferably from the threaded rod 24, to the apertures 28 and 29, thereby permitting charging of the tapes 32 and 34. Tension is maintained in the tapes 32 and 34 by extending their lower ends around hemispherical surfaces formed on the tape supports 42 and 44, respectively. The tape supports 42 and 44 are rigid, insulating bodies (e.g., plastic, ceramic or other insulator) against which coil springs 52 and 54, respectively seat at one end. The supports 42 and 44 are longitudinally slidably mounted coaxially on the rod 20. The springs 52 and 54 are coaxial with the rod 20 and seat at their opposing ends against the fixed bushings 62 and 64, respectively. The bushings 62 and 64 are coaxial with the rod 20 and mount rigidly to the rod 20, such as by set screws, adhesives, or any other rigid fastener. The springs 52 and 54 are pre-compressed between the supports 42 and 44 and the bushings 62 and 64, and therefore a longitudinal force is applied through the supports 42 and 44 to the midpoint of each of the tapes 32 and 34, which forms a mechanical bias on the tapes 32 and 34. This mechanical bias maintains the tapes 32 and 34 in a substantially constant tension, which aligns the longitudinal spans of the tapes substantially parallel to the rod 20 at all times.

It should be noted that the diameters of the hemispherical supports 42 and 44 establish the distance of the tapes 32 and 34 from the exterior of the rod 20 unless other supports intersect the longitudinal spans of the tapes 32 and 34. In a contemplated embodiment, the tapes 32 and 34 are positioned about three inches apart on opposite sides of the rod 20. At least one other support is contemplated, and shown, as the bushing 70 of FIG. 4, between the collar 40 and the supports 42 and 44. Of course, additional such bushings may be placed along the rod 20.

The bushing 70 is mounted just below the tubular shield 80, which is preferably made of PVC or another insulating and non-corroding material. The inner diameter of the shield 80 is slightly larger than the exterior diameter of the rod 20 to provide a small gap between the two through which the tapes 32 and 34 extend. Because the tapes 32 and 34 extend under the shield 80, there is a reduction in the probability of the tapes 32 and 34 providing a good conduction path with any surface to which the electrode 10 mounts or any proximate surface, and thus the shield reduces arcing. The tapes 32 and 34 extend through the gap between the shield 80 and the rod 20 and mount beneath the collar 40, which is positioned just above the top end of the shield 80.

Figure 2:
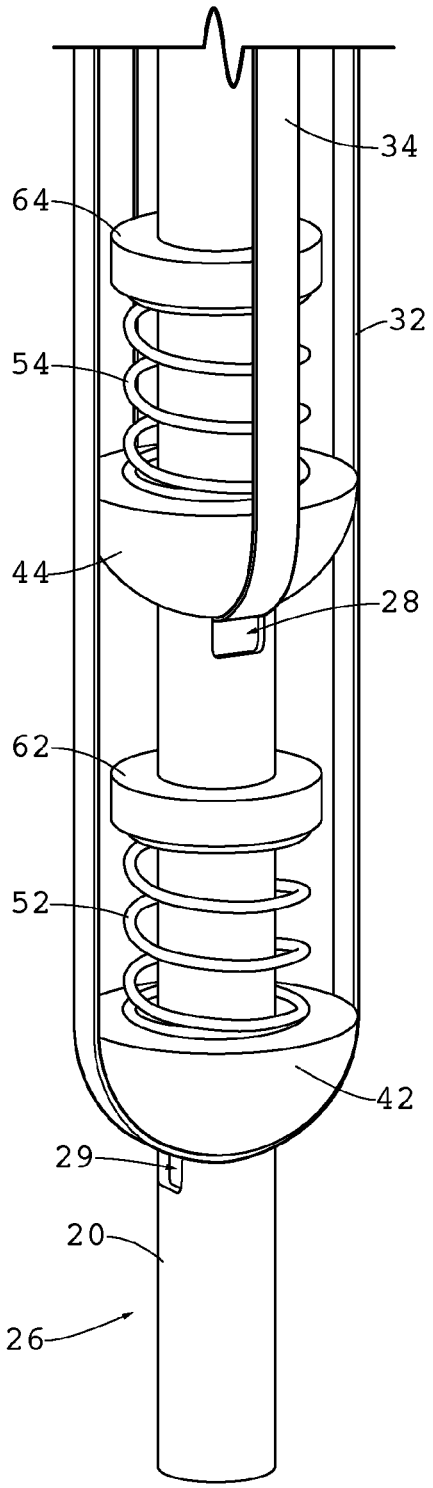
FIG. 2 is a view in perspective illustrating the lower end of the electrode of FIG. 1, and in particular the encircled region designated "FIG. 2" in FIG. 1.
Figure 3:
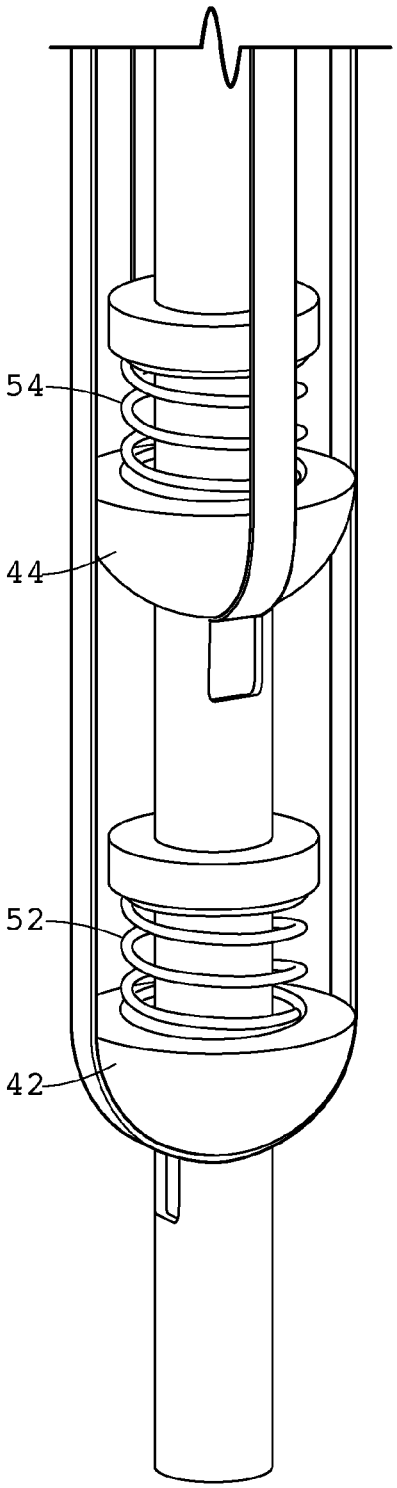
FIG. 3 is a view in perspective illustrating the lower end of the electrode of FIG. 1 with springs in a more compressed state than in FIG. 1.
Figure 4:
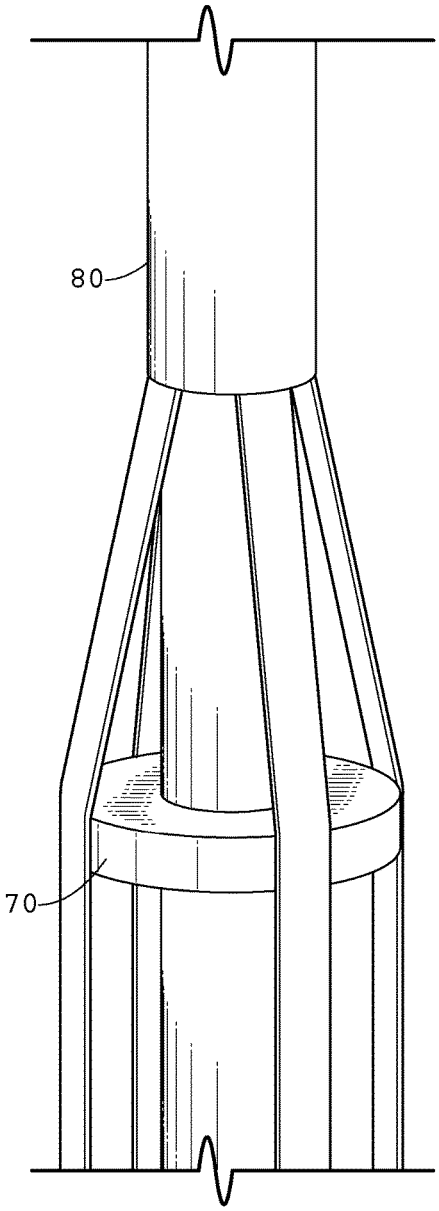
FIG. 4 is a view in perspective illustrating the central region of the electrode of FIG. 1, and in particular the encircled region designated "FIG. 4" in FIG. 1.
Figure 5:
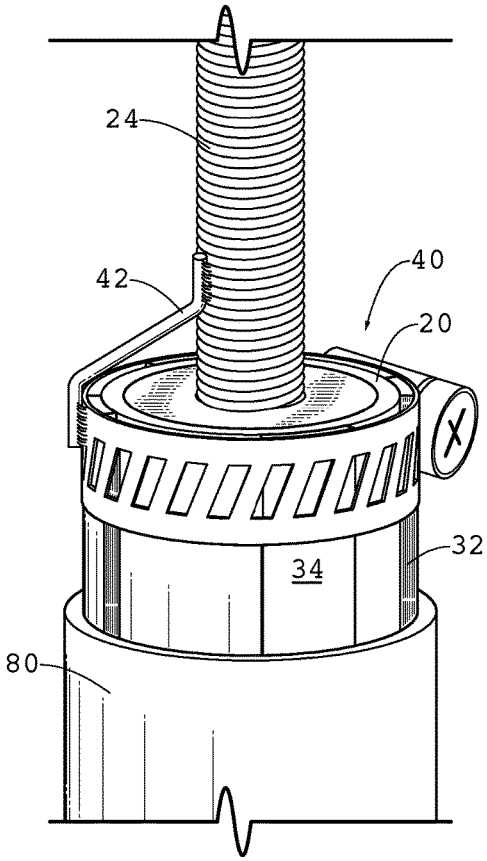
FIG. 5 is a view in perspective illustrating the upper region of the electrode of FIG. 1, and in particular the encircled region designated "FIG. 5" in FIG. 1.

It will become apparent that the tapes 32 and 34, which have conductive carbon fibers infiltrated by a flexible polymer matrix, provide a conductive pathway along the length of the electrode 10, and are held in tension by the mechanical bias exerted against them by the spring-loaded supports 42 and 44. The springs 52 and 54 are shown in FIG. 3 largely compressed as they exert an expansive, longitudinally-directed force against the supports 42 and 44 away from the end of the rod 20 that is mounted to the structure. The springs 52 and 54 are shown in FIG. 2 far more expanded than in FIG. 3. A spring that is contemplated is a commercially available stainless steel spring from Century Spring Corp (Part Number S-1602). This spring has an outer diameter of about 1.5 inches, a free length of about 3.5 inches, a spring rate of about 2.8 lbs/inch, and a recommended maximum load of 7.2 lbs. The spring load is quite small compared to the strength of the support rod, so it will not have a noticeable effect on integrity of the structure. Of course, other springs can be substituted, and even different types of springs are considered "springs" for the purposes of the invention. These include elastomeric springs, pneumatic and/or hydraulic springs, magnetic springs and any other material, structure or apparatus known to impart a spring effect.

It should be noted that the support rod used in the experiments is a fiberglass tube. PVC tubes do not have high strength and stiffness, but could provide sufficient stiffness under some circumstances. Therefore, PVC can be used particularly for shorter electrodes. The preferred electrode is designed for an overall length of about thirteen feet, and this includes the threaded rod 24. As shown in the illustration of FIG. 1, the longitudinal span of the tapes 32 and 34 at approximately three inch spacing is about ten feet. Of course, these distances are merely exemplary, and the electrode can be modified to any practical length.

One advantage of the invention is that there is no requirement for precise adjustments of the tapes 32 and 34 to obtain the exact tension needed to keep the tapes taut. Instead, the mechanical bias away from the mounted end of the tape is applied with a spring that is matched to the particular tape characteristics. This ensures that during initial setup, and even after thermal expansion affects the components of the electrode 10, the tension on the tape remains substantially constant due to the bias that maintains a substantially constant longitudinal force.

The electrode 10 shown in the figures is merely one example of the variety of electrodes that embody the invention. Further examples include those with one tape rather than two, and other contemplated embodiments include three, four or even more tapes. In such contemplated embodiments, each tape would have its own biased support, and the tapes would be spaced from one another around the circumference of the rod.

In addition to the illustrated tapes that are substantially wider than they are thick, the invention contemplates strands that, in cross section, are substantially circular, substantially square, irregular shapes or any other feasible and practical cross-sectional shape. Thus, the strands contemplated as conductive fibers infiltrated by a flexible polymer matrix can take virtually any shape that provides good results. Furthermore, the supports are shown as hemispherical, but could be cylindrical. This is particularly the case if it is desired to prevent the tapes from sliding to one side or another of the hemispherical support.

Figures 6, 7, 8:
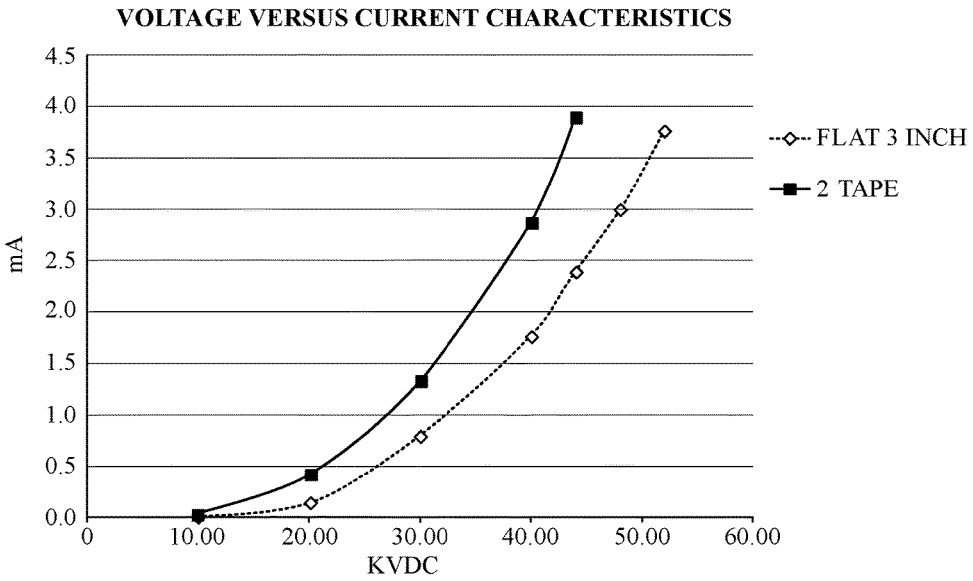
FIG. 6 is a graph illustrating graphically the results of V-I testing on two electrodes in an experimental apparatus.
FIG. 7 is a table including summary data from the experimentation.
FIG. 8 is a pair of tables illustrating the numerical results of V-I testing of each electrode as plotted in the graph of FIG. 6.

The embodiment of the invention illustrated and described above provides excellent results, as shown by the graph of FIG. 6, which is plotted from the data of FIG. 8 as summarized in FIG. 7. It can be seen that the embodiment shown in the illustrations performed better than a conventional electrode, particularly at higher voltage. It is apparent that as the voltage applied to the system (using the embodiment of the invention) increases, more current flows than with the prior art discharge electrode. Because the current flow is a measure of the number of ions formed in the gas flowing through the ESP, higher current at a given voltage indicates greater effectiveness as a discharge electrode.

If a greater current is desired for the embodiment of the present invention, the embodiment could have more or differently-shaped strands mounted to it. Likewise, if less current is desired, fewer or differently shaped strands could be mounted to it. Thus, the invention provides a variable system by which a discharge electrode providing the desired current can be formed merely by adding or removing relatively inexpensive composite tapes or other strands to it.

It is also contemplated to use a bare carbon fiber roving electrode, which is a grouping of substantially parallel fibers that are clustered together but not adhesively attached to one another. The fibers of this embodiment and all of the embodiments preferably have diameters in the range of a few microns, but this can vary by orders of magnitude greater or lesser. The roving is adhered or mechanically mounted as with the above embodiments to the rod, and can be attached along the length thereof by mechanical fasteners.

It is contemplated that any grouping of conductive, non-metallic fibers can be used as an electrode material, and carbon is considered the most viable material. The conductive fibers can be combined with non-conducting fibers, such as glass fibers, in order to obtain some structural or cost-saving advantage. For example, carbon nano-fibers can be combined with glass fibers in a composite through which thermoplastic resin is infiltrated and then cured.

The carbon can be in the form of a roving or tow of fibers, as described above, but also can be in the form of a yarn, such as a string of very short fibers (e.g., nanofibers) clustered together in the manner of a yarn to form an elongated product that is orders of magnitude longer than it is in diameter. Such strings or yarns can be composites, such as by infiltrating with a curable and/or melted thermoplastic polymer fluid. A polymer matrix has the added benefit of aiding in thermal dissipation from the fibers, thereby possibly preventing or mitigating oxidation (burning), but also possibly reducing slightly the effectiveness of the electrode. It is also contemplated to coat carbon fibers with metal, such as HASTELLOY brand alloy or any stainless steel that can withstand the environment and improve the conductivity of the fibers. Additionally, any other material that can withstand the environment can be used to coat the fibers.

Another electrode example is made of a composite tape formed by pultruding a carbon roving through polypropylene to form the tape electrode. The tape is flexible and in the form of a flat strip. The tape is twisted into a helix that spans alongside, and parallel to, the support rod and is attached at opposite ends to the pipe. The tape can also be attached to the pipe along its length. Other examples of electrodes include a carbon roving wrapped helically around a support rod and spaced from the support rod. This is similar to the electrode 10 of FIG. 1, but the tapes are helically wound around the rod 20, rather than parallel to the rod 20.

The electrodes can be extending across a gas flow path, such as a chimney, flue or duct, in the presence of gas flowing rapidly across the electrode in a transverse direction.

Alternatively, the electrodes can be aligned with the flow direction. The position of the tapes 32 and 34 can be altered to improve gas flow and reduce negative impact, such as dead zones, etc.

The light weight of the flexible electrode makes it easier to support and stretch within an ESP. This allows changing or increasing the spacing between the collector plates. Various methods for combining a polymer composite support to the discharge points and making electrical connections with the discharge points are discussed herein. Of course, this discussion is not limiting, but is exemplary, and the person having ordinary skill will readily devise other methods based on the disclosure herein.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A discharge electrode for use in an electrostatic precipitator having a power supply connected to at least one collection electrode and a flow of gas and particles across the discharge electrode and the collection electrode, the discharge electrode comprising:

(a) a non-conductive rod extending into the flow of gas, the rod having a first end attached to a support structure and an opposing, second end that is cantilevered into the flow of gas;

(b) a plurality of conductive fibers forming at least one strand that extends along at least one side of the rod and is exposed to the flow of gas, wherein said at least one strand is electrically connected to the power supply; and (c) a bias mounted to the rod at a first bias end and seated against said at least one strand at a second bias end, the bias thereby applying a longitudinal force to said at least one strand to maintain said at least one strand substantially taut along said at least one side of the rod, wherein the bias further comprises a first support movably mounted to the rod near the second rod end and biased, by a spring mounted to the rod and seating against the first support, toward the second rod end, and wherein said at least one strand extends from near the first rod end over the first support and back toward the first rod end, wherein said first support thereby applies a force to said at least one strand to maintain said at least one strand in a substantially taut configuration.

2. The discharge electrode in accordance with claim 1, wherein the bias further comprises a second support movably mounted to the rod near the second rod end and biased, by a second spring mounted to the rod and seating against the second support, toward the second rod end, and wherein said plurality of conductive fibers further comprises a second strand from near the first rod end over the second support and back toward the first rod end, wherein said second support thereby applies a force to said second strand to maintain said second strand in a substantially taut configuration, wherein said second strand is electrically connected to the power supply.

3. The discharge electrode in accordance with claim 2, wherein said at least one strand comprises a group of carbon fibers seating against one another in a substantially parallel orientation and extending through the flow of gas.

4. The discharge electrode in accordance with claim 3, wherein the group of fibers is spaced radially from the rod, and substantially parallel to the rod, for at least a substantial length of a portion of the rod that extends through the flow of gas.

5. The discharge electrode in accordance with claim 3, wherein said at least one carbon fiber further comprises a group of carbon fibers that has been infiltrated by a matrix material to form a composite and said composite extends through the flow of gas.

6. The discharge electrode in accordance with claim 5, wherein the carbon fibers include at least some nanofibers.

7. A discharge electrode for use in an electrostatic precipitator having a power supply connected to at least one collection electrode and a flow of gas and particles across the discharge electrode and the collection electrode, the discharge electrode comprising:

(a) a non-conductive rod extending into the flow of gas, the rod having a first end attached to a support structure and an opposing, second end that is cantilevered into the flow of gas;

(b) a first support moveably mounted to the rod near the second rod end having a first spring extending between the rod and the support in an at least partially compressed state; and (c) a plurality of conductive fibers forming a first strand that is electrically connected to the power supply and extends along the rod from the first rod end of the rod toward the second rod end, the first strand extends over the first support and along the rod toward the first rod end, wherein the first support imparts a longitudinal force to the first strand to maintain the first strand substantially taut along substantially opposing sides of the rod.

8. The discharge electrode in accordance with claim 7, further comprising:

(a) a second support moveably mounted to the rod near the second rod end having a second spring extending between the rod and the second support in an at least partially compressed state; and (b) a plurality of conductive fibers forming a second strand that is electrically connected to the power supply and extends along the rod from the first rod end toward the second rod end, the strand extends over the second support and along the rod toward the first rod end, wherein said second support imparts a longitudinal force to the strand to maintain said at least one strand taut along substantially opposing sides of the rod.

9. The discharge electrode in accordance with claim 8, wherein the first and the second strands are made up of carbon fibers infiltrated by a polymer matrix to form a composite.

10. The discharge electrode in accordance with claim 9, wherein:

(a) the first support and the second support are coaxially aligned on, and slidable relative to, the rod;

(b) the first spring is a coil spring coaxially mounted on the rod and seating against a first bushing rigidly mounted to the rod;

(c) the second spring is a coil spring coaxially mounted on the rod and seating against a second bushing rigidly mounted to the rod;

(d) a first aperture is formed near the first support through, and transverse to, the rod and through which the first strand passes; and (e) a second aperture is formed near the second support through, and transverse to, the rod through which the second strand passes.

11. The discharge electrode in accordance with claim 9, wherein the first and the second strands extend through a gap formed between a tubular shield mounted substantially coaxially around the rod near the first rod end.

12. The discharge electrode in accordance with claim 11, further comprising a bushing mounted to the rod between the first and second supports and the shield, the bushing interposed between the first and second strands and the rod to maintain a gap between the first and second strands and the rod.

* * * * *